US005649572A

United States Patent [19]

Lile

[11] Patent Number: 5,649,572

[45] Date of Patent: Jul. 22, 1997

[54] FENCING TOOL

[76] Inventor: Kenneth Lile, 2003 Menefee St., Arlington, Tex. 76010

[21] Appl. No.: 652,809

[22] Filed: May 23, 1996

[51] Int. Cl.[6] ..... B21F 15/04

[52] U.S. Cl. ..... 140/57; 140/121; 7/117

[58] Field of Search ..... 7/117, 125, 128; 81/305, 306, 311; 140/52, 56, 57, 117, 118, 121, 123, 124

[56] References Cited

U.S. PATENT DOCUMENTS

| | | | |
|---|---|---|---|
| D. 319,958 | 9/1991 | Fletcher | D8/52 |
| 678,583 | 7/1901 | Osley | 140/121 |
| 876,963 | 1/1908 | Hoak | 81/311 |
| 3,385,326 | 5/1968 | Easton | 140/123 |
| 3,507,305 | 4/1970 | Crabb | 140/106 |
| 3,805,854 | 4/1974 | Self | 140/117 |
| 4,090,390 | 5/1978 | Barinaga | 72/410 |
| 4,270,737 | 6/1981 | Binns et al. | 256/48 |
| 4,917,154 | 4/1990 | Roberson, Sr. | 140/57 |
| 5,303,748 | 4/1994 | Haldemann | 140/123 |

OTHER PUBLICATIONS

Abstract of United States Patent No. 5,335,701 entitled "Tie–Bar Tool For Attaching Fencing Wire To A Post With A Tie–Wire Clip".

*Primary Examiner*—Lowell A. Larson
*Attorney, Agent, or Firm*—Charles D. Gunter, Jr.

[57] ABSTRACT

A fencing tool is shown for attaching a wire to a metal fence post with a wire clip. The tool has first and second elongate portions, each of which has a working end and a handle end. The working ends of each elongate portion has an outwardly extending flange portion and a clip receiving aperture. Each elongate portion also has a mating protrusion formed thereon for matingly engaging the aperture of the opposite respective elongate portion to securely grip a wire clip being bent about a fence wire.

11 Claims, 3 Drawing Sheets

FENCING TOOL

BACKGROUND OF THE INVENTION

1. Field of the Invention:

The present invention relates generally to a fencing tool and, more specifically, to a fencing tool used to attach a fence wire to a metal fence post with a wire clip.

2. Description of the Prior Art:

Today, many farmers and ranchers utilize metal fence posts to erect, e.g., single strand, woven wire and barbed wire type fences. Maintaining the fence in good condition requires continual maintenance. Livestock, wild life and the elements of nature continually work to loosen and break down erected fences. Many farmers and ranchers are required to inspect and repair existing fences on a frequent basis.

A wire, woven wire or barbed wire fence referred to herein as a "wire" fence, is typically attached to a metal fence post by the use of wire clips. Upon positioning the wire against a metal post, each clip has a V-shaped central portion which is received about the metal fence post and opposing ends which pass over the fence wire for fastening in a coil around the wire on either side of the post.

When engaged in either fence erection or repair using wire clips of this type, most farmers and ranchers find it necessary to have a pair of pliers or other tool which will allow one to install or remove clips from metal posts, crimp wire, cut wire, and the like. However, to fasten these clips tightly with conventional tools, such as a conventional screwdriver or pliers, requires considerable effort. This is particularly true in the case of woven wire and barbed wire fences.

The present invention has as its object to provide an improved fencing tool for use in wire handling and wire fence installation, particularly to facilitate the attachment of a wire to a metal fence post with a metal clip.

Another object of the invention is to provide a fencing tool which can perform auxiliary functions such as crimping wire, cutting wire, and the like.

Another object of the invention is to provide such a tool which is simple in design and economical to manufacture.

SUMMARY OF THE INVENTION

The fencing tool of the invention is used to attach a fence wire to a metal fence post. The fencing tool has first and second elongate portions which are pivotally joined in a scissor-like fashion, each elongate portion having a working end and a handle end. A pivot point is located between the working end and handle end of each elongate portion. The working end of each of the first and second elongate portions of the tool includes a mating plier-like Jaw region. At least a selected one of the first and second elongate portions has an outwardly extending flange portion having an arcuate outer edge which joins a curved lower edge, the curved longer edge terminating in an inner edge. The inner edge is provided with a clip receiving aperture for receiving a portion of a wire clip used to install the fence wire on the fence post. By engaging a portion of the wire clip within the aperture, a user can exert a bending force on the wire clip. The other of the elongate portions includes a protrusion on the working end thereof which moves into and out of the vicinity of the aperture in the inner edge of the selected elongate portion as the elongate portions are pivoted about the pivot point to thereby engage the wire clip portion within the aperture. Preferably, both of the elongate portions are provided as mirror images, wherein both elongate portions have a working end with an outwardly extending flange portion and a clip receiving aperture and wherein each elongate portion has a mating protrusion thereon for matingly engaging the aperture of the opposite respective elongate portion.

The fencing tool of the invention is used to mount a metal wire about a metal fence post which has a generally T-shaped cross-section, one face of the post having a plurality of longitudinally extending nubs on an exterior surface thereof for supporting fence wire being attached. The wire clip which is engaged by the fencing tool of the invention has a generally V-shaped central portion which terminates in a pair of oppositely extending bends, the V-shaped central portion being adapted to be received about the rear of the metal fence post with the oppositely extending bends passing over and about the fence wire on either side of the fence post. The curved lower edges of the outwardly extending flange portions of the tool of the invention act as camming surfaces which engage and cooperate with the fence wire for applying a bending force to the wire clip being mounted.

The plier-like jaw regions of the working ends of each elongate portion are joined by an interior concave surface to the remaining interior surface thereof. The remaining interior surface terminates in the previously described protrusion which cooperates with the opposite respective aperture for engaging a wire clip. The interior concave surfaces of the elongate portions of the tool form a central opening when the plier-like jaw regions of the working ends of the tool are brought together, whereby a length of fence wire can be received within the central opening when the plier-like jaw regions are closed to grasp a portion of the wire clip being bent.

Additional objects, features and advantages will be apparent in the written description which follows.

DETAILED DESCRIPTION OF THE INVENTION

Figure 3:
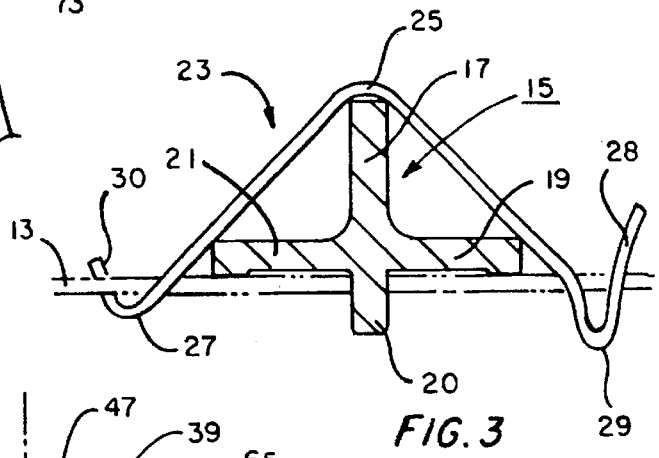
FIG. 3 is a top, cross-sectional view of a T-shaped metal fence post showing a wire clip being received about a strand of wire which is being attached to the fence post.
Figure 2:
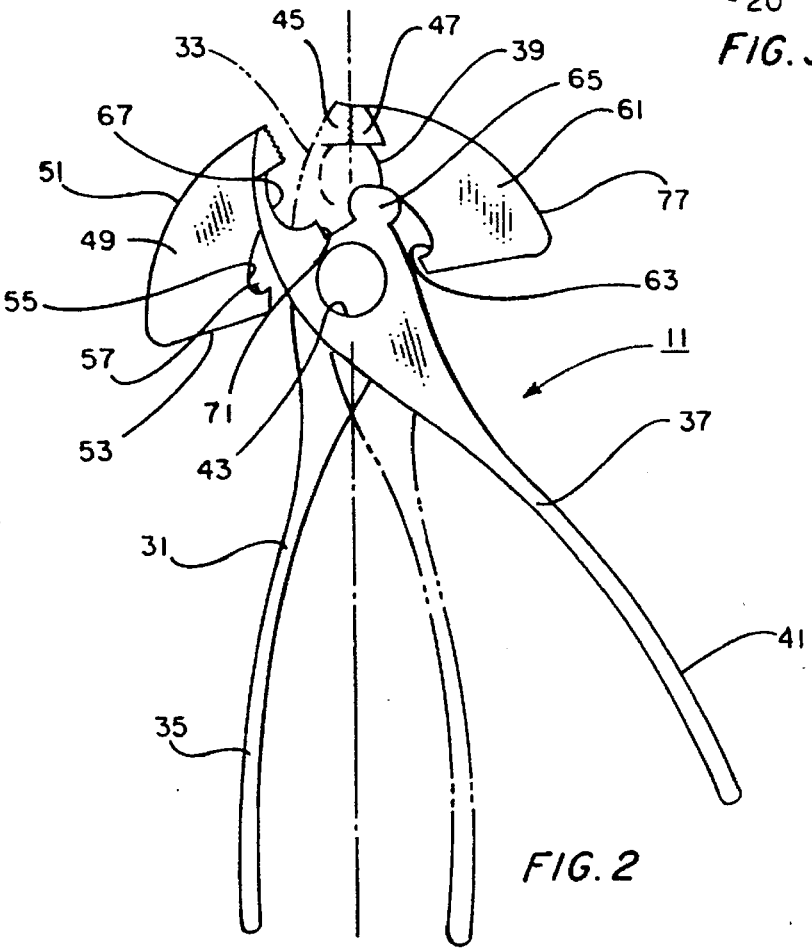
FIG. 2 is a top, perspective view of the fencing tool of the invention with the plier-like jaws in the open position, the closed position of the jaws being indicated in phantom lines.
Figure 4:
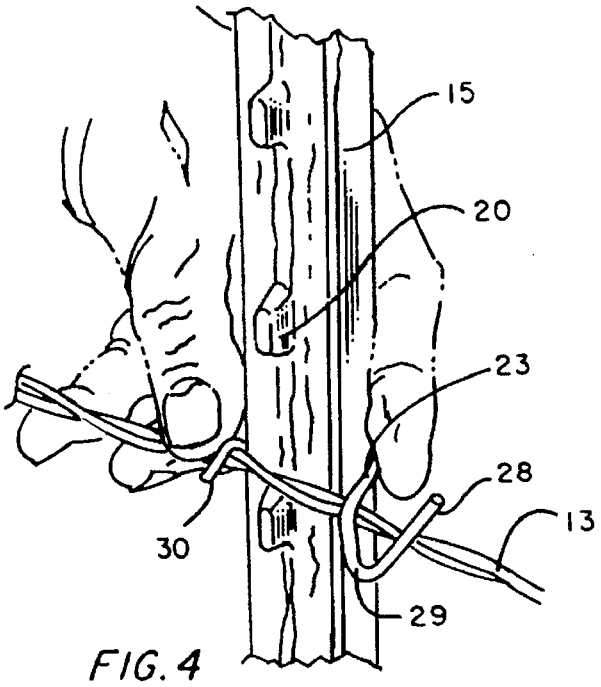
FIG. 4 is a partial, perspective view of a fence post and fence wire showing the positioning of the mounting clip about the fence post.
Figure 5:
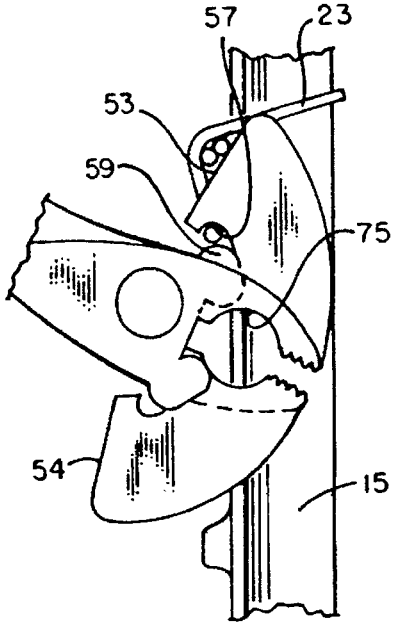
FIG. 5 is a partial side view of the fencing tool of the invention showing the initial operational position thereof, the fence wire being shown in section.
Figure 6:
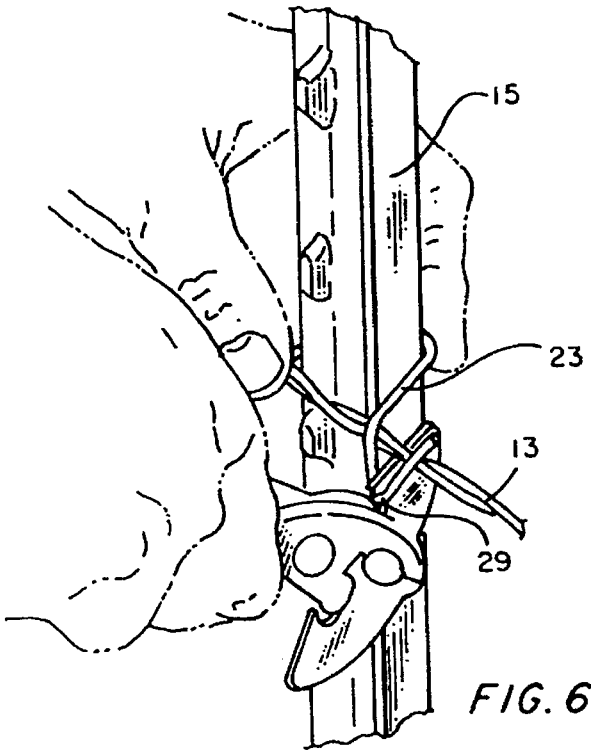
FIGS. 6–9 are partial, perspective views of a metal fence post showing the operation of the fencing tool of the invention in installing a fence wire by means of a V-shaped wire clip.

The fencing tool of the invention is designated generally as 11 in FIG. 2. The fencing tool 11 is used to attach a wire, such as woven metal wire 13 (FIG. 4) to a metal fence post 15. As best seen in FIGS. 3 and 4, the metal fence post 15 has a generally T-shaped cross-section formed by a center section 17 and left and right opposing sections 19, 21. A plurality of nubs 20 extend longitudinally down an exterior surface of the fence post 15. The fencing tool of the invention is used with a wire clip 23 to attach the fence wire 13 to the metal post 15. As shown in FIG. 3, the wire clip has a generally V-shaped central portion 25 which terminates in a pair of oppositely extending bends or extents 27, 29. The V-shaped central portion 25 is adapted to be received about the center section 17 of the T-type metal fence post 15 with the oppositely extending bends 27, 29 passing over and about the fence wire 13 which is being attached to the fence post 15. In the embodiment shown, the clip 23 has one outer extent 28 which flares upwardly in an opposite direction from the other extent 30 thereof. The outer extent 30 passes back under the fence wire 13 in the initial position shown in FIG. 3 while the outer extent 28 flares upwardly on the wire side of the fence post.

As best shown in FIG. 2, the fencing tool 11 includes a first elongate portion 31 having a working end 33 and a handle end 35. A second elongate portion 37 also has a working end 39 and a handle end 41. The second elongate portion 37 is pivotally joined to the first elongate portion 31 in scissor-like fashion at a pivot point 43 located between the working end and handle end thereof.

The working ends 33, 39 of each of the first and second elongate portions 31, 37 include mating plier-like jaw regions 45, 47 which form gripping surfaces when the jaw regions are in the closed position (illustrated in phantom lines in FIG. 2). At least a selected one of the first and second elongate portions has an outwardly extending flange portion 49 having an arcuate outer edge 51 which joins a curved lower edge 53. The curved lower edge 53 terminates in an inner edge 55. The inner edge 55 is provided with a clip receiving aperture or recess 57 for receiving a portion of the wire clip for exerting a bending force on the wire clip.

Figure 1:
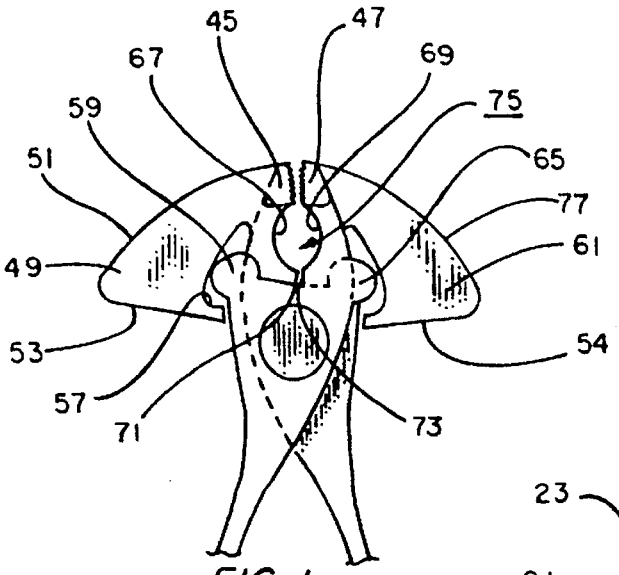
FIG. 1 is a partial, top view of the fencing tool of the invention showing the working ends thereof.

As best seen in FIG. 1, the other of the elongate portions includes a protrusion 59 on the working end thereof which moves into and out of contact with, or the near vicinity of, the aperture opening 57 in the inner edge 55 of the selected elongate portion 31 as the elongate portions 31, 37 are pivoted about the pivot point 43. Movement of the protrusion from the open, clip receiving position to the locked, clip engaging position is illustrated by the solid line illustrations in FIGS. 2 and 1, respectively. In this way, a user can securely engage the wire clip portion within the aperture 57.

Preferably, both of the elongate portions 31, 37 are provided as mirror images, as shown in FIGS. 1 and 2, wherein both elongate portions 31, 37 have a working end 33, 39 and an outwardly extending flange portion 49, 61 and a clip receiving aperture 57, 63. Similarly, each elongate portion 31, 37 has a protrusion 59, 65 for matingly engaging the aperture 57, 63 of the opposite respective elongate portion. By providing the elongate portions as mirror images, the fencing tool can be easily utilized by either left handed or right handed persons and it is not critical which side of the tool is first grasped or picked up.

As shown in FIG. 1, the plier-like jaw regions 45, 47 of the working ends 33, 39 are joined by an interior concave surface 67, 69 to a right angle interior surface 71, 73, thereof. The right angle interior surfaces 71, 73 terminate in the protrusions 59, 65, previously described. Preferably, the right angle surfaces 71, 73 provide cutting surfaces for cutting wire when the plier-like jaw regions 45, 47 are brought to the closed position shown in FIG. 2. As shown in FIG. 1, the interior concave surfaces 67, 69 form a central opening 75 when the plier-like jaw regions of the working ends 31, 37 of the tool are brought together, whereby a length of fence wire can be received within the central opening 75 when the plier-like jaw regions are closed to grasp a portion of a wire clip being bent. As will be explained, the curved lower edges 53, 54 of the outwardly extending flange portions 49, 61 of the tool act as camming surfaces which engage and cooperate with the fence wire 13 for applying a bending force to a wire clip 23 being mounted during part or all of the installation process.

Figure 7:
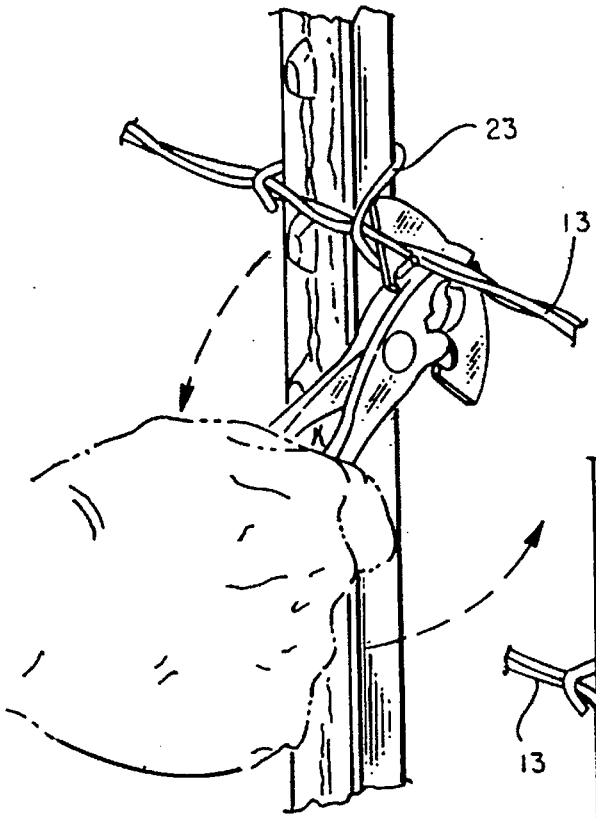
Figure 8:
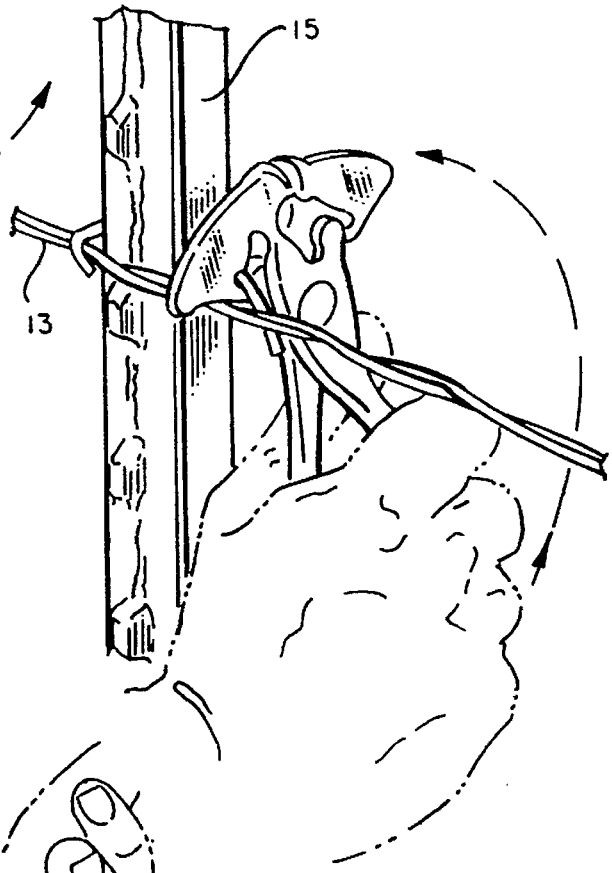
Figure 9:
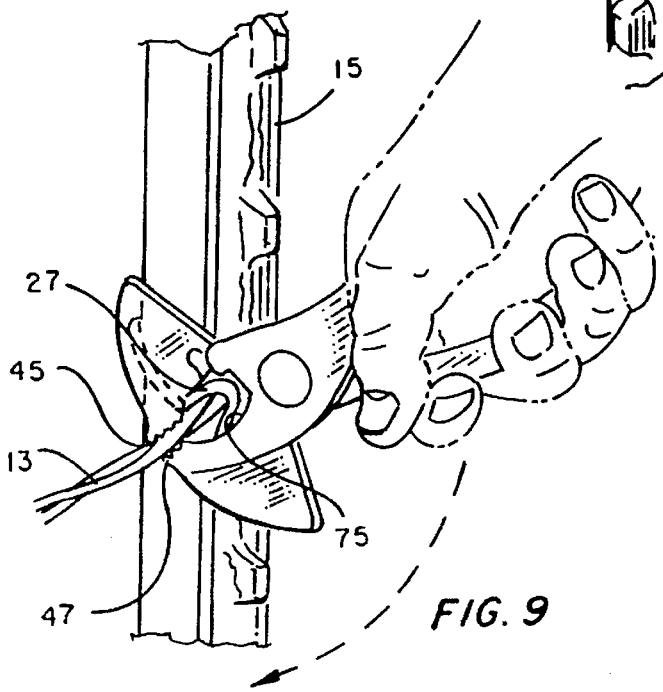

FIGS. 4–9 illustrate the operation of the fencing tool 11 of the invention in installing a wire clip 23 about a fence wire 13 in order to mount the wire 13 on the metal fence post 15. As shown in FIG. 4, the wire clip 23 is first placed about the fence post 15 with the central portion 25 received about the rear face of the fence post and with the outwardly extending bends 27, 29 being passed over and around the wire 13 being mounted. Outer extent 30 passes back under the fence wire 13 to help in initially positioning the wire clip. The user grasps the tool 11 by the handle ends thereof and engages a bend 29 of the wire clip 23 between the aperture 57 and protrusion 59 (see FIGS. 5 and 6) of the tool. While moving the curved inner edge 53 against the fence wire generally perpendicular thereto and rotating the elongate portions 31, 37 as shown in FIGS. 7 and 8, the clip outer extent 28 is gradually bent under, over and around the fence wire 13. The tool is then used to twist and attach the opposite bend 27 about the fence wire 13 on the opposite side of the post 15. As shown in FIG. 9, the plier-like jaw regions of the tool 45, 47 can be opened and passed over the clip bend 27 and wire 13 so that the clip and wire are received within the central opening 75 thereof. The plier-like Jaw regions 45, 47 can then be used to grasp and bend the clip portion 27 to complete the installation.

An invention has been provided with several advantages. The fencing tool of the invention is simple in design and economical to manufacture. The fencing tool has specialized surfaces which facilitate grasping and exerting a bending force on a V-shaped wire clip for installing a fence wire on a metal fence post. The curved edge regions of the tool flanges exert camming forces on the fence wire to facilitate the bending movement. The cooperating protrusions and apertures on the working ends of the tool securely grasp the respective outer extents of the wire clip. The plier-like jaw regions can perform a variety of working tasks and the right angle interior surfaces 71, 73 of the working ends can be used to cut wire. The other rounded or arcuate surfaces of the tool, as well as the rounded central opening 75 help to prevent the wire from being accidentally cut during the clip installation. The central opening 75 of the tool will pass over a barb in a barbed wire fence, if necessary for the clip installation. The mirror image design of the tool facilitates use by either a left or right handed person and eliminates the necessity of gripping the tool in a particular starting position.

While the invention has been shown in only one of its forms, it is not thus limited but is susceptible to various changes and modifications without departing from the spirit thereof.

What is claimed is:

1. A fencing tool for attaching a wire to a metal fence post, the fencing tool comprising:

a first elongate portion having a working end and a handle end;

a second elongate portion having a working end and a handle end pivotally joined to the first elongate portion at a pivot point located between the working end and the handle end thereof;

wherein the working end of each of the first and second elongate portions includes a mating plier-like jaw region and wherein at least a selected one of the first and second elongate portions has an outwardly extending flange portion having an arcuate outer edge which joins a curved lower edge, the curved lower edge terminating in an inner edge, the inner edge being provided with a clip receiving aperture for receiving a portion of the wire clip for exerting a bending force on the wire clip, and wherein the other of the elongate portions includes a protrusion on the working end thereof which moves into and out of contact with the aperture in the inner edge of the selected elongate portion as the elongate portions are pivoted about the pivot point to thereby engage the wire clip portion within the aperture.

2. The fencing tool of claim 1, wherein both of the elongate portions are provided as mirror images, wherein both elongate portions have a working end with an outwardly extending flange portion and clip receiving aperture and wherein each elongate portion has a mating protrusion thereon for matingly engaging the aperture of the opposite respective elongate portion.

3. The fencing tool of claim 2, wherein the wire clip which is engaged by the fencing tool has a generally V-shaped central portion which terminates in a pair of oppositely extending bends, the V-shaped central portion being adapted to be received about the metal fence post with the oppositely extending bends passing over and about the fence wire being attached to the fence post.

4. The fencing tool of claim 3, wherein the fencing tool is used to mount a metal wire about a metal fence post which has a generally T-shaped cross section, one face of the post having a plurality of longitudinally extending nubs on an exterior surface thereof for supporting fence wire being attached.

5. The fencing tool of claim 4, wherein the curved lower edges of the outwardly extending flange portions of the tool act as camming surfaces which engage and cooperate with the fence wire for applying a bending force to the wire clip being mounted.

6. The fencing tool of claim 5, wherein the plier-like jaw regions of the working ends of each elongate portion are joined by an interior concave surface to a right angle interior surface thereof, and wherein the right angle interior surface terminates in the protrusion which cooperates with the opposite respective aperture for engaging a wire clip.

7. The fencing tool of claim 6, wherein the interior concave surfaces on the elongate portions of the tool form a central opening when the plier-like jaw regions of the working ends of the tool are brought together, whereby a length of the fence wire can be received within the central opening when the plier-like jaw regions are closed to grasp a portion of the wire clip being bent.

8. A fencing tool for attaching a metal wire to a T-type metal fence post with a metal clip, where the metal clip has a generally V-shaped central portion which terminates in a pair of oppositely extending bends, the V-shaped central portion being adapted to be received about the T-type metal fence post with the oppositely extending bends passing over and about the fence wire being attached to the fence post, the fencing tool comprising:

a first elongate portion having a working end and a handle end;

a second elongate portion having a working end and a handle end pivotally joined to the first elongate portion at a pivot point located between the working end and the handle end thereof;

wherein the working end of each of the first and second portions includes a mating plier-like jaw region and wherein each of the first and second elongate portions has an oppositely arranged, outwardly extending flange portion having an arcuate outer edge which joins a curved lower edge, the curved lower edge terminating in an inner edge, the inner edge being provided with a clip receiving aperture for receiving a selected bend portion of the V-shaped wire clip for exerting a bending force on the V-shaped wire clip, and wherein each of the elongate portions includes a protrusion on its respective working end which moves into and out of contact with the aperture in the inner edge of the other respective elongate portion as the elongate portions are pivoted about the pivot point to thereby engage the bend portion of the V-shaped wire clip within the aperture.

9. The fencing tool of claim 8, wherein the curved lower edges of the outwardly extending flange portions of the tool act as camming surfaces which engage and cooperate with the fence wire for applying a bending force to the V-shaped wire clip being mounted.

10. The fencing tool of claim 9, wherein the plier-like jaw regions of the working ends of each elongate portion are joined by an interior concave surface to a right angle interior surface thereof, and wherein the right angle interior surface terminates in the protrusion which cooperates with the opposite respective aperture for engaging a V-shaped wire clip.

11. The fencing tool of claim 10, wherein the interior concave surfaces on the elongate portions of the tool form a central opening when the plier-like jaw regions of the working ends of the tool are brought together, whereby a length of the fence wire can be received within the central opening when the plier-like jaw regions are closed to grasp a portion of the V-shaped wire clip being bent.

* * * * *